US006258146B1

(12) United States Patent
Semedard

(10) Patent No.: US 6,258,146 B1
(45) Date of Patent: Jul. 10, 2001

(54) INLET DUCT FOR ADMITTING FLUE GASES INTO A CYCLONE SEPARATOR

(75) Inventor: Jean-Claude Semedard, Paris (FR)

(73) Assignee: ABB Alstom Power Combustion, Velizy-Villacoublay (FR)

( * ) Notice: Subject to any disclaimer, the term of this patent is extended or adjusted under 35 U.S.C. 154(b) by 0 days.

(21) Appl. No.: 09/476,369

(22) Filed: Jan. 3, 2000

(30) Foreign Application Priority Data

Jan. 18, 1999 (FR) ..... 99 00465

(51) Int. Cl.[7] ..... B04C 5/14
(52) U.S. Cl. ..... 55/459.3; 55/337; 55/459.1
(58) Field of Search ..... 55/337, 345, 459.1, 55/459.2, 459.3, 459.4; 210/512.1

(56) References Cited

U.S. PATENT DOCUMENTS 3,853,512 * 12/1974 Hayashi ..... 55/459.3
5,788,848 * 8/1998 Blanche et al. ..... 55/459.1
5,958,094 * 9/1999 Schwamborn et al. ..... 55/459.1
6,083,291 * 7/2000 Okada et al. ..... 55/337

FOREIGN PATENT DOCUMENTS 0 763 384 A1 3/1997 (EP) .

* cited by examiner

*Primary Examiner*—David A. Simmons
*Assistant Examiner*—Minh-Chau T. Pham
(74) *Attorney, Agent, or Firm*—Sughrue, Mion, Zinn, Macpeak & Seas, PLLC

(57) ABSTRACT

A flue gas inlet duct into a separator cyclone, the duct having two lateral faces one of which is referred to as the "extrados" face and the other of which is referred to as the "intrados" face, the intrados face terminating at the tip of the cyclone, the duct also having a top face and a bottom face, wherein at least one of the intrados face and the extrados face has sloping grooves extending downwards from the outlet of the furnace towards the cyclone separator.

1 Claim, 2 Drawing Sheets

INLET DUCT FOR ADMITTING FLUE GASES INTO A CYCLONE SEPARATOR

The present invention relates to an inlet duct for admitting flue gases into a cyclone separator.

BACKGROUND OF THE INVENTION

The invention applies in particular, but in non-limiting manner, to large installations, e.g. 250 MW to 600 MW, that include a plurality of cyclone separators placed side by side at the outlet from the furnace. In such installations, there is a lack of room for positioning the inlet ducts to the separators properly because of the space occupied to pass various beams. Thus, conventionally, the disposition of the inlet duct to a cyclone separator at the outlet from a furnace is as shown in FIG. 1, which is a diagrammatic plan view of a cyclone separator 1 together with its inlet duct 2 at the outlet from the furnace 3. This inlet duct has two side faces 4 and 5, together with a bottom face and a top face that are not visible in this view.

The face 4 is referred to as the "intrados" face and terminates at the tip of the cyclone D, while the face 5 is referred to as the "extrados" face.

Having the duct positioned in this way, due as mentioned above to lack of space, is not favorable to obtaining a separator that works with good efficiency.

Given that the duct is very short, solids present in the top portion thereof do not have time to settle out within the duct. As a result, a large fraction of these solids reach the inlet to the cyclone via the top portion of the duct, from which a non-negligible proportion of them is entrained into the gas outlet from the cyclone.

OBJECT AND SUMMARY OF THE INVENTION

An object of the present invention is to mitigate that drawback and to improve the efficiency of such cyclone separators.

The present invention thus provides a flue gas inlet duct into a separator cyclone, said duct having two lateral faces, one of which is referred to as the "extrados" face and the other of which is referred to as the "intrados" face, the intrados face terminating at the tip of the cyclone, the duct also having a top face and a bottom face, wherein at least one of the intrados face and the extrados face has sloping grooves extending downwards from the outlet from the furnace towards the cyclone separator.

BRIEF DESCRIPTION OF THE DRAWINGS

The invention is described below with reference to the accompanying drawings, in which.

MORE DETAILED DESCRIPTION

Figure 1:
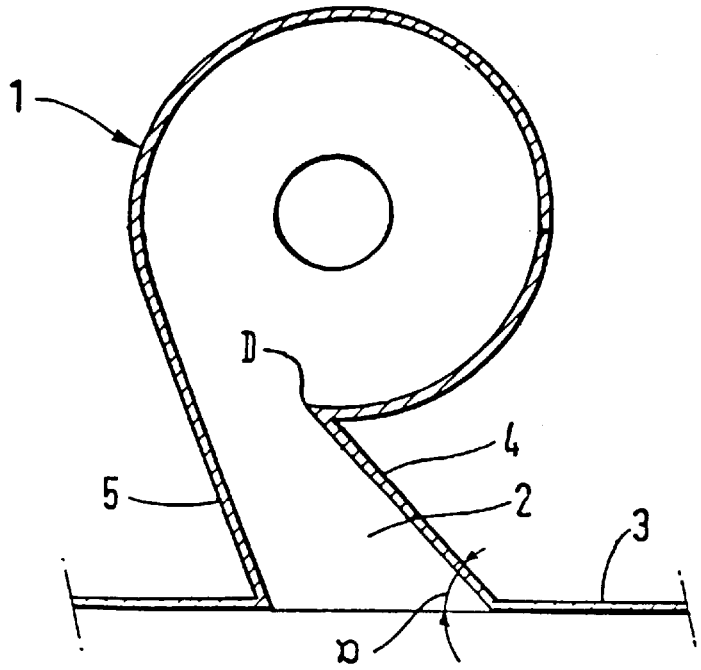
FIG. 1 PRIOR ART
FIG. 1, described above, is a diagram of the prior art configuration.
Figure 2:
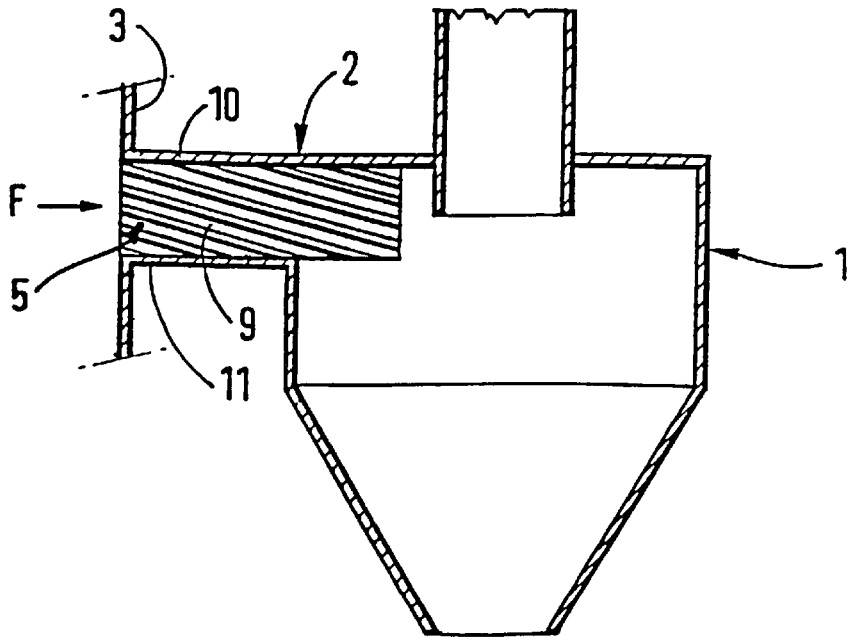
FIGS. 2, 3, and 4 are three diagrammatic views for showing the disposition of the invention.

With reference to FIG. 2, there can be seen a diagram of a cyclone separator 1 and its inlet duct 2, shown in elevation. In accordance with the invention, the extrados face 5 has grooves 9. Such grooves can also be provided on the intrados face 4.

Figure 3:
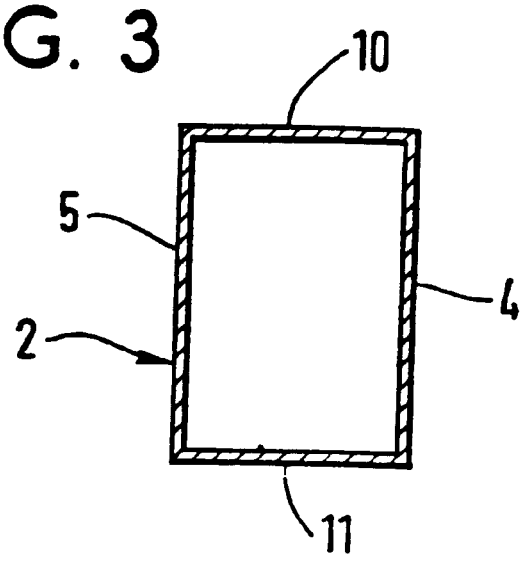

FIG. 3 is merely a simplified diagram showing the inlet section for flue gases in the duct 2 when travelling in the direction of arrow F in FIG. 2, and serves to identify the four faces of the duct 2: intrados face 4; extrados face 5; top face 10; and bottom face 11.

The grooves 9 slope relative to the horizontal at an angle lying in the range 5° to 25°.

Figure 4:
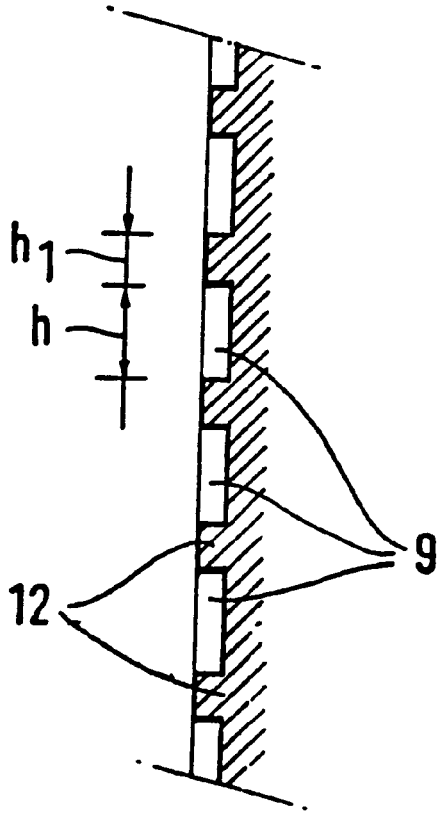

FIG. 4 is a diagram showing the section of the grooves. Advantageously, each groove is of height h lying in the range 200 mm to 400 mm, and it is of a depth that does not exceed 50 mm, and adjacent grooves are separated by solid portions 12 of height $h_1$ lying in the range 100 mm to 300 mm.

The purpose of this disposition is to favor gravitational separation at the inlet to the cyclone.

Naturally, although the grooves shown are of rectangular section, it is possible for the grooves to be of some other section, e.g. avoiding any sharp angles.

What is claimed is:

1. A flue gas inlet duct into a cyclone separator, said duct having two lateral faces one of which is an extrados face and the other of which is an intrados face, the intrados face terminating at a tip of the cyclone separator, the duct also having a top face and a bottom face, wherein at least one of the intrados face and the extrados face has sloping grooves extending downwards from an outlet of a furnace towards the cyclone separator.

* * * * *